US010869801B1

(12) United States Patent
Skripps et al.

(10) Patent No.: US 10,869,801 B1
(45) Date of Patent: Dec. 22, 2020

(54) LIMB HOLDER APPARATUS AND RELATED METHODS

(71) Applicant: Kyra Medical, Inc., Northborough, MA (US)

(72) Inventors: Thomas K. Skripps, Acton, MA (US); Howard P. Miller, Concord, MA (US)

(73) Assignee: Kyra Medical, Inc, Northborough, MA (US)

( * ) Notice: Subject to any disclaimer, the term of this patent is extended or adjusted under 35 U.S.C. 154(b) by 33 days.

(21) Appl. No.: 16/223,106

(22) Filed: Dec. 17, 2018

Related U.S. Application Data

(60) Provisional application No. 62/708,597, filed on Dec. 14, 2017.

(51) Int. Cl.
*A61G 13/12* (2006.01)
*A61G 13/00* (2006.01)

(52) U.S. Cl.
CPC ..... *A61G 13/1245* (2013.01); *A61G 13/0009* (2013.01); *A61G 13/0018* (2013.01); *A61G 13/128* (2013.01)

(58) Field of Classification Search
CPC .. A61G 13/12; A61G 13/1205; A61G 13/121; A61G 13/1235; A61G 13/124; A61G 13/1245; A61G 13/125; A61G 13/128; A61G 13/0009; A61G 13/0018
See application file for complete search history.

(56) References Cited

U.S. PATENT DOCUMENTS

| | | | | |
|---|---|---|---|---|
| 2,057,992 | A | 10/1936 | Wiruth | |
| 3,226,105 | A * | 12/1965 | Weickgenannt | A61G 13/12 5/624 |
| 4,708,510 | A * | 11/1987 | McConnell | A61G 13/12 403/137 |
| 4,886,258 | A | 12/1989 | Scott | |
| 5,025,802 | A * | 6/1991 | Laico | A61G 13/12 128/875 |
| 5,802,641 | A | 9/1998 | Van Steenburg | |
| 5,961,085 | A * | 10/1999 | Navarro | A47C 16/00 128/878 |
| 5,961,512 | A * | 10/1999 | Purnell | A61F 5/3761 606/1 |
| 6,058,534 | A | 5/2000 | Navarro et al. | |
| 6,202,230 | B1 * | 3/2001 | Borders | A61G 13/0009 5/613 |
| 6,263,531 | B1 | 7/2001 | Navarro et al. | |
| 6,564,406 | B2 | 5/2003 | VanSteenburg et al. | |
| 6,594,839 | B1 * | 7/2003 | Papay | A61G 13/12 297/405 |
| 6,704,959 | B2 | 3/2004 | Schuerch | |
| RE41,412 | E | 7/2010 | Van Steenburg | |

(Continued)

FOREIGN PATENT DOCUMENTS

| | | | |
|---|---|---|---|
| EP | 1014911 | B1 | 7/2000 |
| WO | 9844890 | A1 | 10/1998 |

*Primary Examiner* — Robert G Santos
*Assistant Examiner* — Rahib T Zaman
(74) *Attorney, Agent, or Firm* — Nelson Mullins Riley & Scarborough LLP; Thomas J. Engellenner; Reza Mollaaghababa

(57) ABSTRACT

A limb support structure is disclosed. The limb support structure can include a one or more support structures, a locking swivel joint, and a gas pistol mounting element.

9 Claims, 12 Drawing Sheets

(56) References Cited

U.S. PATENT DOCUMENTS

| | | | | |
|---|---|---|---|---|
| 8,322,342 | B2 * | 12/2012 | Soto | A61G 13/12 128/845 |
| 8,448,274 | B2 | 5/2013 | Broens | |
| 10,188,573 | B2 | 1/2019 | Moriarty et al. | |
| 2001/0039680 | A1 * | 11/2001 | Boucher | A61G 13/0072 5/623 |
| 2002/0128577 | A1 * | 9/2002 | Smart | A61G 13/0045 602/36 |
| 2006/0225743 | A1 | 10/2006 | Schuerch | |
| 2009/0145443 | A1 * | 6/2009 | Dreyfuss | A61G 13/101 128/845 |
| 2011/0190676 | A1 * | 8/2011 | Torrie | A61G 13/123 602/32 |
| 2012/0318278 | A1 | 12/2012 | Aboujaoude et al. | |
| 2015/0250672 | A1 * | 9/2015 | Fossez | A61G 13/125 5/630 |
| 2016/0120726 | A1 * | 5/2016 | Moriarty | A61G 13/0036 5/649 |
| 2017/0165143 | A1 | 6/2017 | Schuerch, Jr. | |
| 2017/0239119 | A1 * | 8/2017 | Stewart | A61H 1/0259 |
| 2017/0360512 | A1 * | 12/2017 | Couture | A61B 34/25 |
| 2019/0216665 | A1 | 7/2019 | Miller et al. | |
| 2019/0254905 | A1 | 8/2019 | Lane, II et al. | |
| 2020/0022861 | A1 | 1/2020 | Miller et al. | |

* cited by examiner

LIMB HOLDER APPARATUS AND RELATED METHODS

RELATED APPLICATIONS

The present application claims priority to and benefit of U.S. Provisional Application No. 62/708,597, filed on Dec. 14, 2017, the entire teachings of which is incorporated by reference herein.

FIELD

The present disclosure generally relates to limb holders, such as patient limb holders for use in surgery and related methods for making same.

BACKGROUND

During most surgical operations, nurses and surgical and support staff are often responsible for tending to the general health and safety if a patient. For example, nurses and surgical staff often tend to patients while they are under anesthesia or while they are recovering after a surgical procedure. In doing so, nurses and surgical staff often consider a variety of factors to ensure patients' safety. For example, in addition to considering factors for mitigating possible risks associated with the surgical procedure at hand, nurses and hospital staff must also ensure that the patient's possibly unconscious body is also protected from possible physical injuries that may be caused by unwanted movement of the patient's body (e.g., unconscious movement and repositioning of the patient while under anesthesia or sleeping).

SUMMARY

The present disclosure relates to a patient support and positioning apparatus and related methods. For example, in one aspect, an apparatus for supporting and/or stabilizing a limb of a patient (e.g., patient's arm or leg) is disclosed. The apparatus can include a gas piston mechanism configured to increase a range of motion of a surgical support structure. An increase in the range of motion of a surgical support structure can be required/desired in many modem surgical procedures. Generally, a support apparatus according to the embodiments disclosed herein can be used to support and stabilize a patient's limb(s) before, during, and/or after a surgical procedure.

In one aspect, an apparatus for supporting and positioning a patient's limb during a surgical procedure is disclosed. The apparatus can include a support device assembly that comprises one or more support structures for supporting the patient's limb during a surgical procedure. The patient's limb can comprise any limb, such as the patient's arm(s) or leg(s). A proximal locking swivel joint can be coupled to a proximal end of the support structure such that the proximal locking swivel joint can hold the support structure in at least one position relative to the surgical table. A proximal gas piston mounting element can be connected, directly or indirectly, to a mount plate to which a proximal locking swivel joint is attached. Further, a distal gas piston mounting element can be connected, directly or indirectly, to a distal point on the support structure, relative to the proximal swivel locking joint, and a gas piston assembly can be connected on one end to the proximal gas piston mounting element and on the opposite end to the distal gas piston mount element such that at least one of the two mounting elements is movable while the support structure is moved through its range of motion, extending the range of motion beyond that possible if both mounting elements were fixed.

In another aspect, an apparatus for supporting and positioning a patient's limb (e.g., leg) during a surgical procedure is disclosed. The apparatus can include a support device assembly comprising one or more support structures for supporting the patient's limb during the surgical procedure, a proximal locking swivel joint coupled to a proximal end of the support structure, wherein the proximal locking swivel joint holds the support structure in at least one position relative to the surgical table, a distal gas piston mounting element connected to a point distal on the support structure relative to the proximal swivel locking joint and a proximal gas piston mounting element connected to an attachment member, such member being attached either directly, or indirectly, to a mount plate. The apparatus can also include a proximal locking swivel joint which is attached to same mount plate, a gas piston assembly connected on one end to the proximal gas piston mounting element and on the opposite end connected to the distal gas piston mount element, wherein at least one of the two mounting elements is movable between at least two relative positions while the support structure is moved through its range of motion, extending the range of motion beyond that possible if both mounting elements were fixed.

In yet another aspect, an apparatus for supporting and positioning a patient's limb during a surgical procedure is disclosed. The apparatus comprises one or more support structures for supporting the patient's limb during the surgical procedure, a proximal locking swivel joint coupled to a proximal end of the support structure, wherein the proximal locking swivel joint holds the support structure in at least one position relative to the surgical table, a distal gas piston mounting element connected to a point distal on the support structure relative to the proximal swivel locking joint and a gas piston assembly connected to the distal gas piston mounting element and at the proximal piston end point where the proximal piston end point is connected to a leg, bracket, or other mounting element which, in turn, is attached to a mount plate common to the locking swivel joint whereby the leg, bracket or mounting element can move relative to the proximal locking swivel joint and/or the proximal locking swivel joint and where the distal piston end point has a fixed mounting location along the support structure as the gas piston is extended through the range of motion of the support structure to which it is attached.

In another aspect, an apparatus for supporting and positioning a patient's limb during a surgical procedure is disclosed. The apparatus comprises a support device assembly comprising one or more support structures for supporting the patient's leg during the surgical procedure, a proximal locking swivel joint coupled to a proximal end of the support structure, wherein the proximal locking swivel joint holds the support structure in at least one position relative to the surgical table, a distal gas piston mounting element connected to a point distal on the support structure relative to the proximal swivel locking joint and a gas piston assembly connected to the distal gas piston mounting element and at a proximal piston end point where the proximal piston end point is connected to a leg, bracket, or other mounting element which, in turn, is attached to a mount plate common to the locking swivel joint whereby the leg, bracket or mounting element can move relative to the proximal locking swivel joint and/or the proximal locking swivel joint and where the distal piston end point is allowed to move between at least two relative positions along the support structure by means of sliding, pivoting, rotating or other means.

In other examples, the aspects above, or any system, method, apparatus described herein can include one or more of the following features.

Other aspects and advantages of the invention can become apparent from the following drawings and description, all of which illustrate the various aspects of the invention, by way of example only.

BRIEF DESCRIPTION OF THE DRAWINGS

A detailed description of various embodiments is provided herein below with reference, by way of example, to the following drawings. It will be understood that the drawings are exemplary only and that all reference to the drawings is made for the purpose of illustration only, and is not intended to limit the scope of the embodiments described herein below in any way. For convenience, reference numerals may also be repeated (with or without an offset) throughout the figures to indicate analogous components or features.

DETAILED DESCRIPTION

Figure 1:
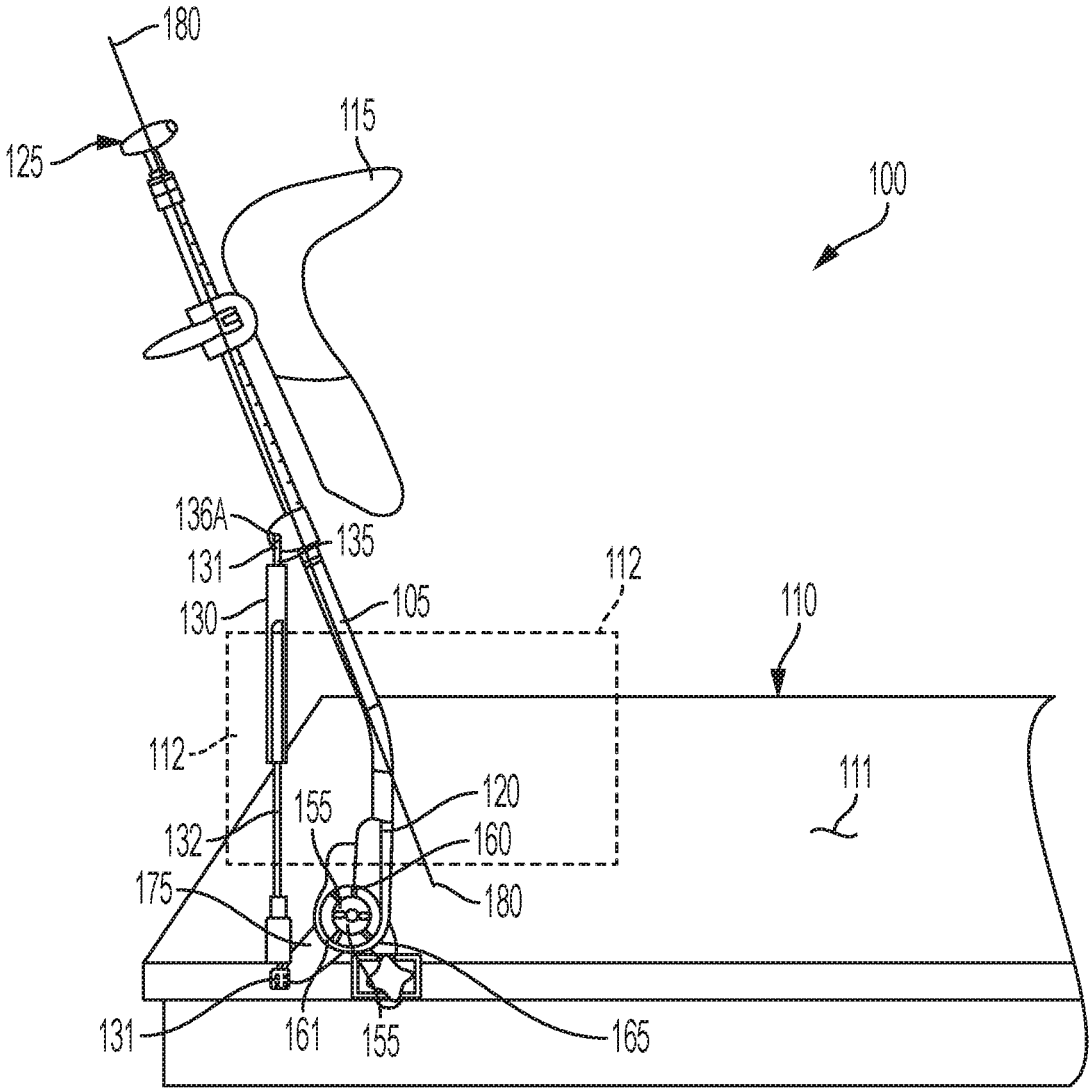
FIG. 1 schematically illustrates a lithotomy positioning system according to some embodiments disclosed herein.

The present disclosure relates to a patient support and positioning apparatus and related methods. Patients undergoing surgical procedures are often moved to an operating room table surface, where they remain until the procedure is completed. Once the procedure is complete, patients are often moved to a recovery area. Positioning devices are often used before, during, and/or after a surgical procedure to protect patients and their bodies from unwanted impact, skin abrasions, pressure sores, nerve damage, or other hazards. For example, devices, such as stirrups, can be used to position a patient's leg (or patient's both legs) during procedures involving the lower abdomen or groin. Similarly, support devices can be used to position and stabilize a patient's arm (or both arms) during procedures involving the shoulder or arm.

Although a variety of patient positioning devices are known in the art, since surgical staff often use surgical gloves and gown to maintain a sterile surgical site, it is important that they are able to adjust positioning devices, which are often at least partially non-sterile, without breaking the sterile field of a surgical room (e.g., operating room). Generally, a limb holder, such as lithotomy stirrups, can be mounted to a surgical table and have a patient support structure that is movable by means of a locking pivoting joint, actuated by means of a distal handle. Such stirrups are often used to position legs, for example, during gynecological and urological procedures.

Further, some limb holders enable distal actuation of the motion of the supporting structure relative to surgical table using a proximal locking swivel joint. This feature can allow clinicians to adjust the patient's limb position through a sterile drape, at a distance from the surgical site (typically the groin or abdomen). Sterile drapes are often made of a clear material that allows the surgical staff to see the distal handle and actuate it manually, while maintaining proper protocols to maintain the sterile field. In addition, limb holders can have a gas piston that is intended to provide an upward force to assist in offsetting the weight of supported limb while surgical staff adjust the position of the limb.

Limb holders and extremity holders can also allow distal actuation of simultaneous axes of motion (including abduction/adduction and high/low lithotomy positioning), enabling intraoperative motion of the support structure. This distal actuation can be accomplished through the use of actuation rod, or rods, located within a hollow support structure (e.g., a tube). This actuation mechanism and support structure follow a path from the a distal handle to the proximal side, locking pivoting joint mechanism and translating the rotational motion of the distal handle along a rigid path to a mechanism that locks and releases the pivoting joint. The support structure is fixed to the movable portion of the locking pivoting joint mechanism and can be released to move through various ranges of motion relative to the fixed portion of the pivoting joint mechanism. In turn, the fixed portion of the pivoting joint mechanism can be secured to a mounting plate that is mated to the surgical table using the available mounting rail and common rail clamps. Without an actuation force applied to the distal handle, the movable portion of the swivel joint mechanism cannot move relative to the fixed portion (due to a frictional interface or otherwise), holding the support structure in place relative to the surgical table. When the distal handle is actuated, the movable portion of the swivel joint mechanism is released from the fixed portion, allowing relative motion and repositioning until the actuating force is released from the handle.

In a limb holder arrangement, the rotation of the actuation handle, the rotation of the actuation rod, and the rotation of the proximal locking swivel joint release mechanism and the structure of the supporting member often share the same linear axis. A gas piston can be attached at each end to rigid mount structures. For example, one end of the gas piston can be attached to the support structure, at a distal end, while the other can be attached to a point on the mount plate, referred here as the proximal end. The distal end can remain fixed to the support structure and the proximal endpoint can remain fixed relative to the mount plate. Each end can also be secured to its respective mount point by means of a swivel joint (e.g., spherical rod end bearing). Other than the motion enabled by these end bearings, the spatial location of the mounting points can be fixed. By fixing one end of the gas piston mechanism to the mount plate and the other end to a fixed point on the support structure, the gas piston mechanism can extend and contract between a minimum and maximum relative distance between endpoints while the support structure is moved through its typical lithotomy range of motion. However, since a typical gas piston mechanism cannot extend beyond the maximum or contract below the minimum relative distance between the distal and proximal endpoint. Therefore, the range of motion of the support structure can be consequently limited.

Many modern robotic surgical techniques employ multiple tool arms and tools that are used in surgical procedures requiring limb positioning, and can be located laterally and/or medially relative to the patient's limb or limbs. Further, some robotic procedures can require that the patients head be elevated to 45 degrees above the feet (e.g., a "reverse Trendelenburg position") while other procedures require the feet to be elevated up to 45 degrees above the head (e.g., the "Trendelenburg position"). Furthermore, some surgical procedures can require that the patient is moved from one of these positions to another. Therefore, surgical tables are often moved through these various angles, requiring limb stirrups to also be moved through a wide range of angles to support the patient's limb(s) accordingly. These procedures can require the limb holder supporting the limbs to have a range of motion of up to 140°; from low lithotomy (−55°) to neutral lithotomy (0°) to high lithotomy (+85°). However, conventional limb holders often have flaws that render them suboptimal in such modern surgical scenarios.

The plane parallel to the surgical table surface can be considered neutral lithotomy. However, this extreme range of motion was not contemplated when distally actuated stirrups were originally introduced. For example, currently available and conventional distally actuated limb holders utilize gas pistons that are mounted at two fixed points, limiting the range of motion of stirrups to under 120°. In order to overcome this limitation in procedures where lithotomy range of motion exceeds about 118°, clinicians are often forced to break the sterile field and adjust the clamp holding the stirrup onto at the surgical table rail, which takes time and can introduce additional risk of infection.

Surgical limb holders according to embodiments disclosed herein overcome these limitations by providing a a lithotomy range of motion greater than limb holders presently available in the art. For example, in one aspect, embodiments disclosed herein extend the range of a gas piston mechanism for a limb support structure, thereby increasing the range of motion of the surgical support structure.

FIG. 1 schematically illustrates a a lithotomy positioning system 100 according to some embodiments disclosed herein. The system 100 can include a limb holder structure 105 (which can be linear or non-linear) connected to a surgical table 110 via an accessory rail (not shown). During surgery or other clinical procedures, the patient's limb (the term "leg" is used herein, one having ordinary skill in the art should appreciate that embodiments disclosed herein can be used to support any limb of a patient) is secured in boot 115 and the limb holder support structure 105 holds the patient's limb at a desired position. It should be noted that, although a single limb holder support structure 105 is shown in FIG. 1 for simplicity, two limb holders can be employed to support both legs/limbs of the patient. A lithotomy axis 150 can be generally perpendicular to the mount plate 175 and can also be generally parallel to the table mount surface 111. The range of motion of the limb holder structure can be bounded by a "high lithotomy" position 160 and a "low lithotomy" position 161. Neutral lithotomy can be parallel with surface 111 of surgical table 110 (identified using reference number 165). In some implementations, a mount plate 175 is used to mount the system 100 to the surgical table. The medial plane 112 represents a plane passing through the center of the patient, dividing into a left and right half. The lithotomy positioning system 100 can rotate about the lithotomy axis 150 when positioning a patient's legs upwards or downwards relative to the table mount surface 110, moving between high lithotomy 160 and low lithotomy 161 positions.

Due to the spherical nature of some swivel joint mechanism, the support structure can also move toward or away from the medial plane, referred to as "abduction" and "adduction", respectively.

As shown in FIG. 1, the limb holder support structure allows for the distal actuation of the patient's leg using distal actuation handle 125 to actuate the proximal swivel joint 120. The proximal swivel joints can operate in any suitable manner known in the art.

The gas piston 130 (with gas strut 132) can have a spherical rod end bearing 131 attached to the distal end of the gas piston 130 at an attachment point 135. The distal rod end bearing 131 can be configured to mate with a mount bracket 133 at a mating point 136A. The gas strut 132 can have another rod end bearing on its proximal end, attaching at proximal attachment point 136B. Due to the spherical design of rod end bearings 131, the support structure can move through the lithotomy range of motion, while simultaneously moving in abduction or adduction.

Figure 2A:
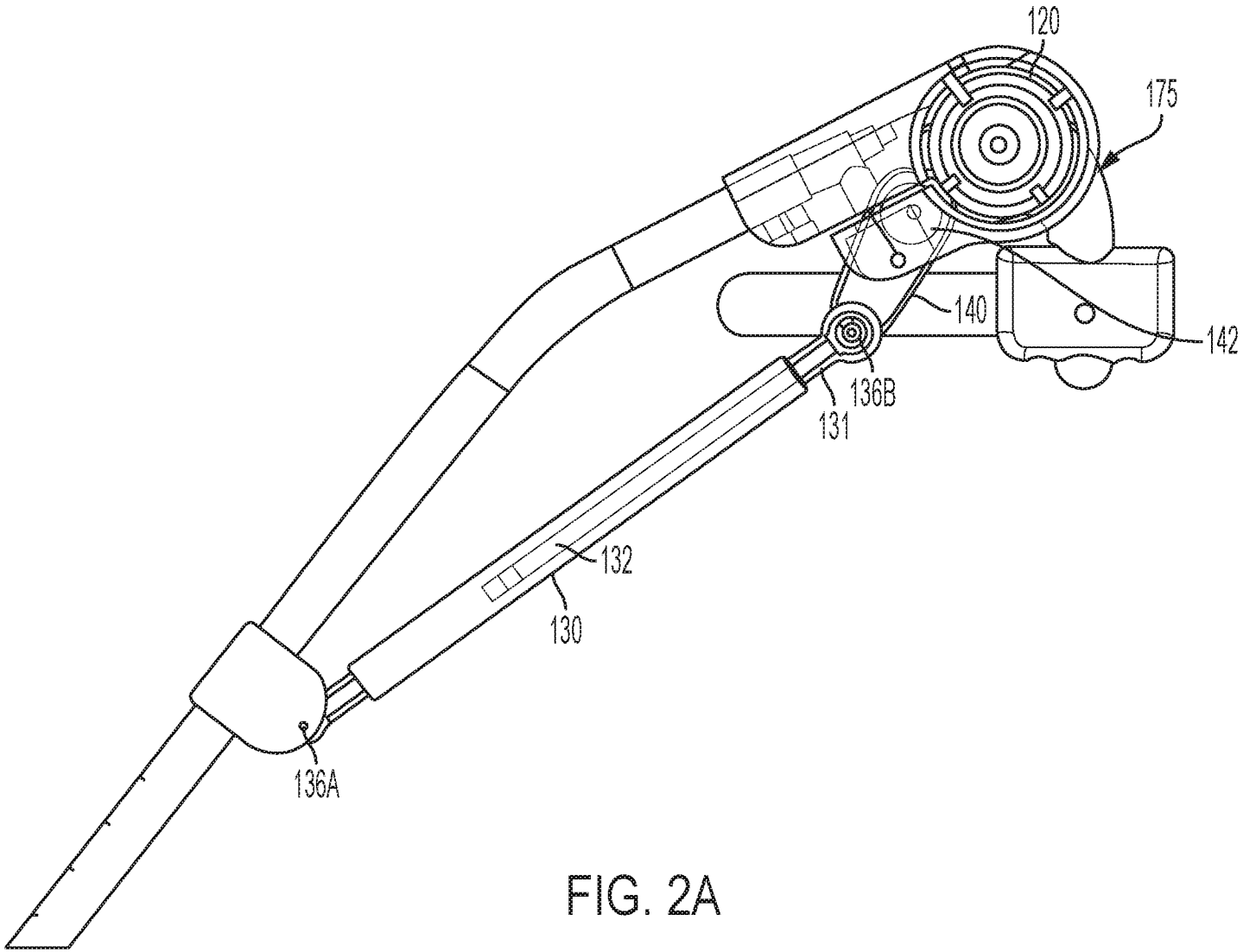
FIG. 2A schematically illustrates a gas piston according to some embodiments disclosed herein.

FIG. 2A schematically illustrates a gas piston mount when the limb holder is in low lithotomy position. As shown, the gas piston strut 132 can be almost fully compressed into gas piston 130. The proximal end of gas piston strut 132 can be attached to pivot bracket 140 via joint end bearing 131, which has a spherical bearing at proximal attachment point 136 allowing rotation of the gas piston assembly through the lithotomy and abduction/adduction range of motion. Pivoting bracket leg 140 can comprise a bored hole at its proximal end into which rotation hub 142 can be fitted, thus mounting the pivot bracket leg to mount bracket 175 (shown in FIG. 3). This can allow the pivot bracket to rotate about the center of hub 142, allowing the mount point 136B of the proximal end of the gas piston strut to move relative to the mount bracket 175.

Figure 2B:
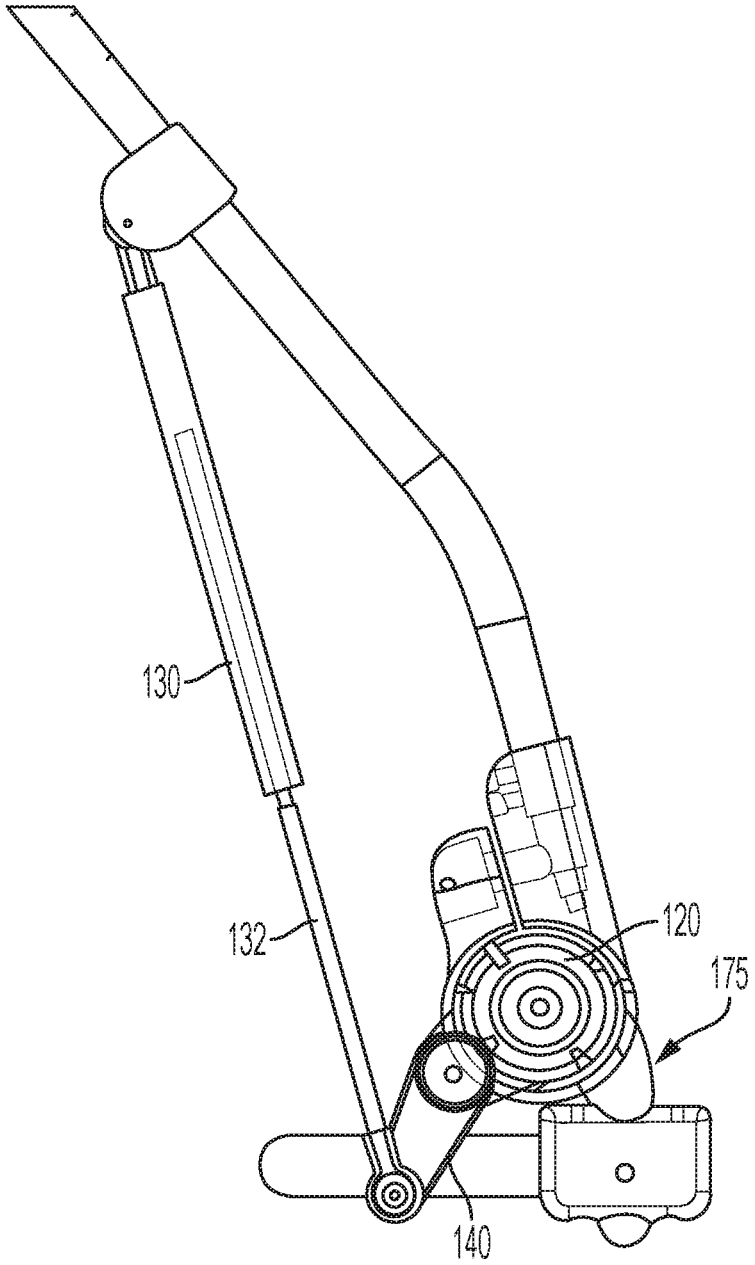
FIG. 2B schematically illustrates a proximal gas piston according to some embodiments disclosed herein.

FIG. 2B schematically illustrates a proximal gas piston mount when the support structure is moved into the mid-range of high lithotomy. As shown, the gas strut 132 can be fully extended from gas piston 130. The pivot bracket 140 can be in the same position as that shown in FIG. 2A relative to mount plate 175 and proximal swivel joint 120. This illustrates the maximum lithotomy range if the pivot bracket 140 is not able to move.

Figure 2C:
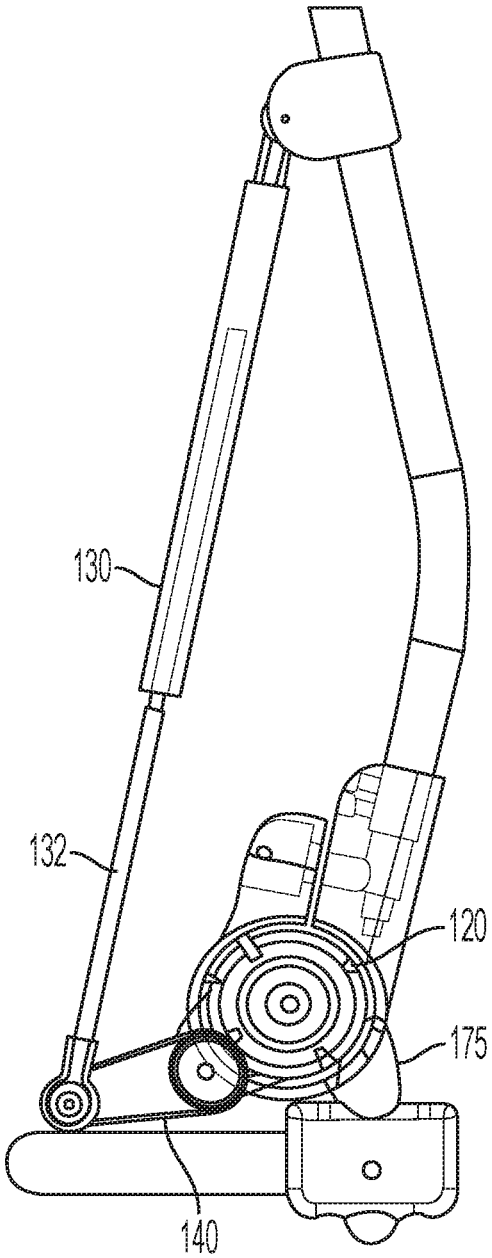
FIG. 2C schematically illustrates a proximal gas piston mount according to some embodiments disclosed herein.

FIG. 2C illustrates a proximal gas piston mount when the support structure is moved into a higher lithotomy position than represented in FIG. 2A and FIG. 2B. The gas piston strut 132 can fully extend from gas piston 130 and pivot bracket 140 is pivoted upwards, relative to the proximal swivel joint 120 and mount plate 175 when compared it position in FIG. 2A and FIG. 2B. The upward rotation of pivot bracket 140 can allow the support structure to be moved into higher lithotomy positions than what is possible if proximal attachment point of the gas piston is not moving.

Figure 2D:
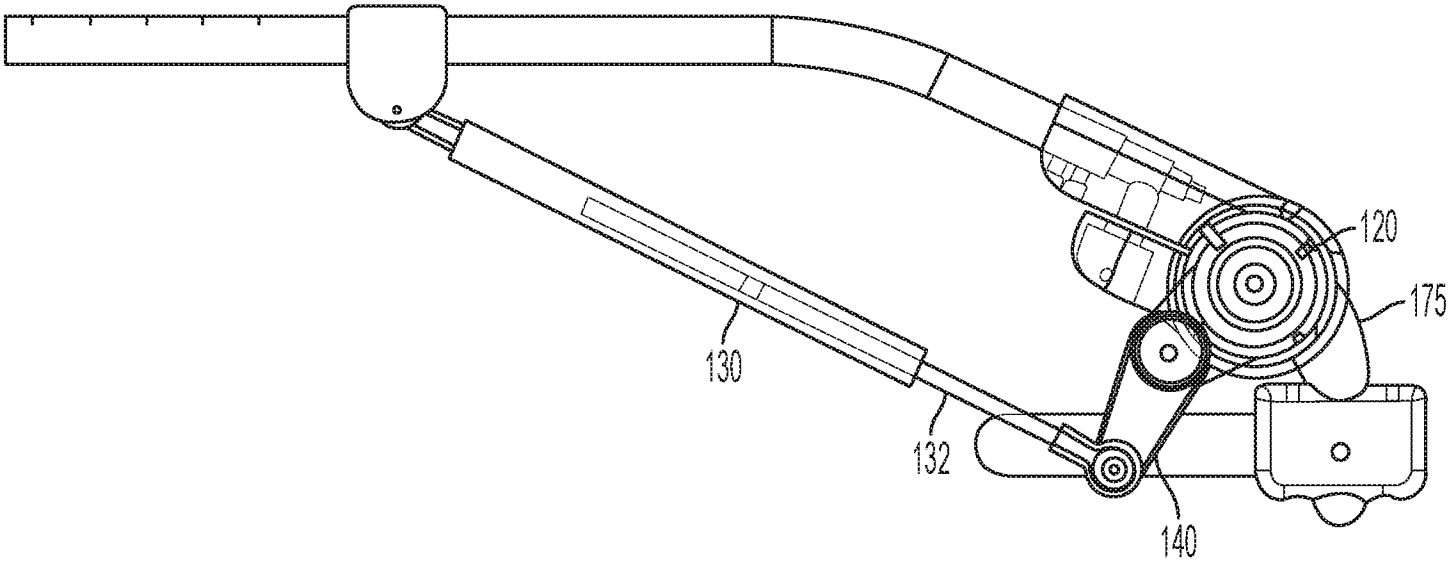
FIG. 2D schematically illustrates another proximal gas piston mount according to some embodiments disclosed herein.

FIG. 2D provides a close up view of one such embodiment of the proximal gas piston mount. Here the support structure is in the neutral lithotomy position. Specifically, the gas piston strut 132 is partially extended from gas piston 130 and pivot bracket 140 is in the same relative position to proximal swivel joint 120 and mount plate 175 as in FIG. 2A. This further illustrates that in lithotomy positions in which the gas piston strut 132 is in a relative position to gas piston 130 other than fully extended, the spring force within the gas piston assembly can force mount pivot 140 to its lowermost position.

Figure 3:
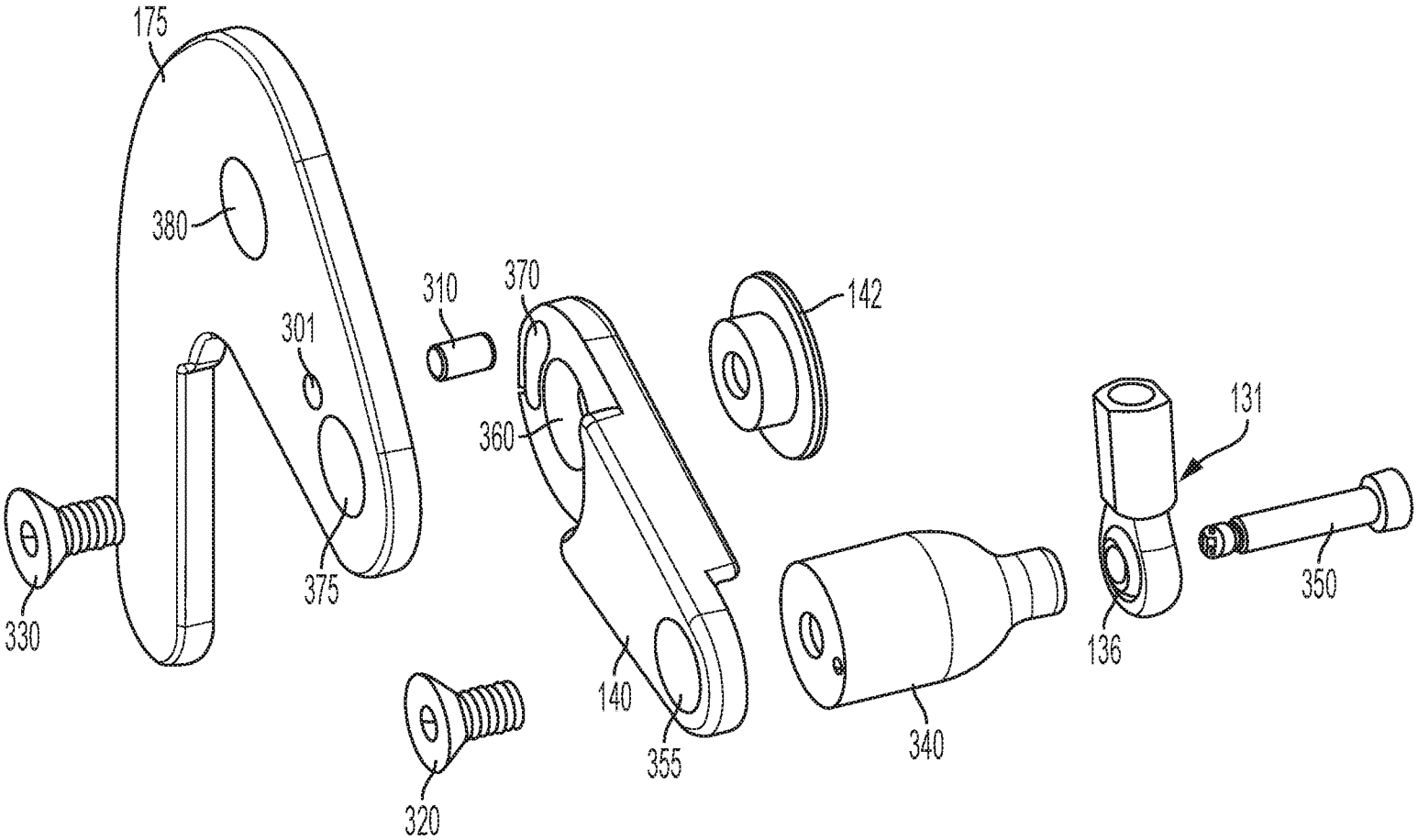
FIG. 3 schematically illustrates an exploded isometric view of a gas piston strut mount and pivot bracket assembly according to some embodiments disclosed herein.

FIG. 3 provides an exploded isometric view of one embodiment of the gas piston strut mount and pivot bracket assembly. The mount plate 175 can be attached at its lateral side to the proximal swivel joint 120 (not shown) using a hole 380 and a means of attachment (typically a machine screw). Mount post 340 can be attached to pivot bracket 140 by screw 320 which can be passed through hole 355. Gas piston strut rod end bearing 131 can comprise a spherical bearing at attachment point 136. Shoulder screw 350 passes through the mating hole in 136 and into threaded hole in mount post 340, thus attaching gas piston assembly (not shown) to pivot bracket 140. Range of motion dowel 310 can be fitted into range of motion control slot 370 (in pivot bracket 140) and into hole 301 in mount plate 175. Attachment screw 330 can be fitted through hole 375 in mount bracket 175 and through hole 360 in pivot bracket 140 and into a threaded hole in rotational hub 142, thus allowing rotation of pivot bracket 140 relative to mount plate 175 and proximal swivel joint (not shown, see proximal swivel joint 120).

Figure 4:
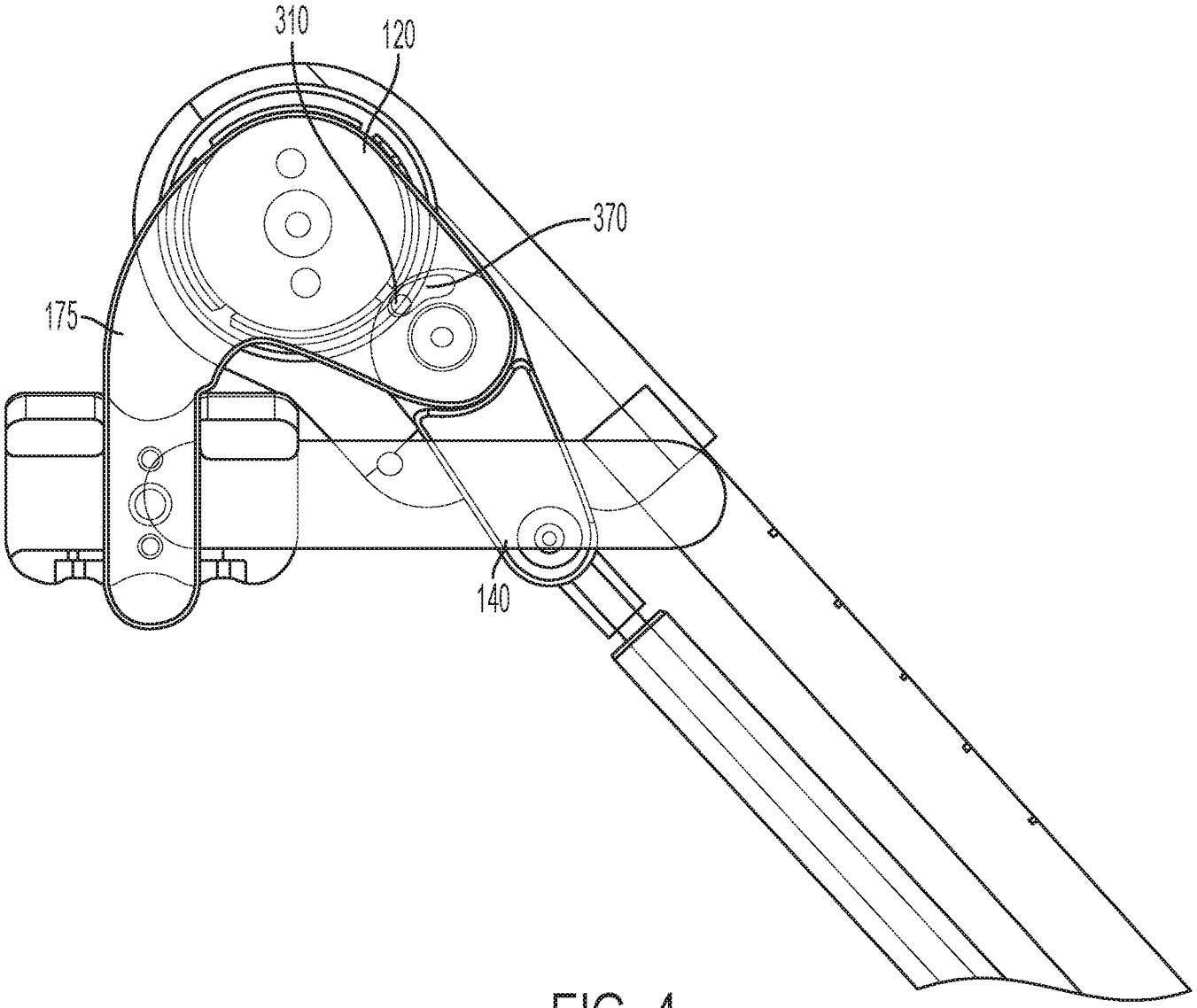
FIG. 4 schematically illustrates a lateral view of a range of motion of a pivot bracket according to some embodiments disclosed herein.

FIG. 4 provides a lateral view of one embodiment and shows how the range of motion of pivot bracket 140, relative to mount plate 175 and proximal swivel joint 120, is controlled. As shown, the pivot bracket 140 is in its lowest pivot position with range of motion with dowel 310 positioned against the left edge of range of motion control slot 370. This interference between dowel 310 and slot 370 can prevent pivot bracket 140 from rotating further downward relative to mount plate 175 and proximal locking swivel joint 120.

Figure 5:
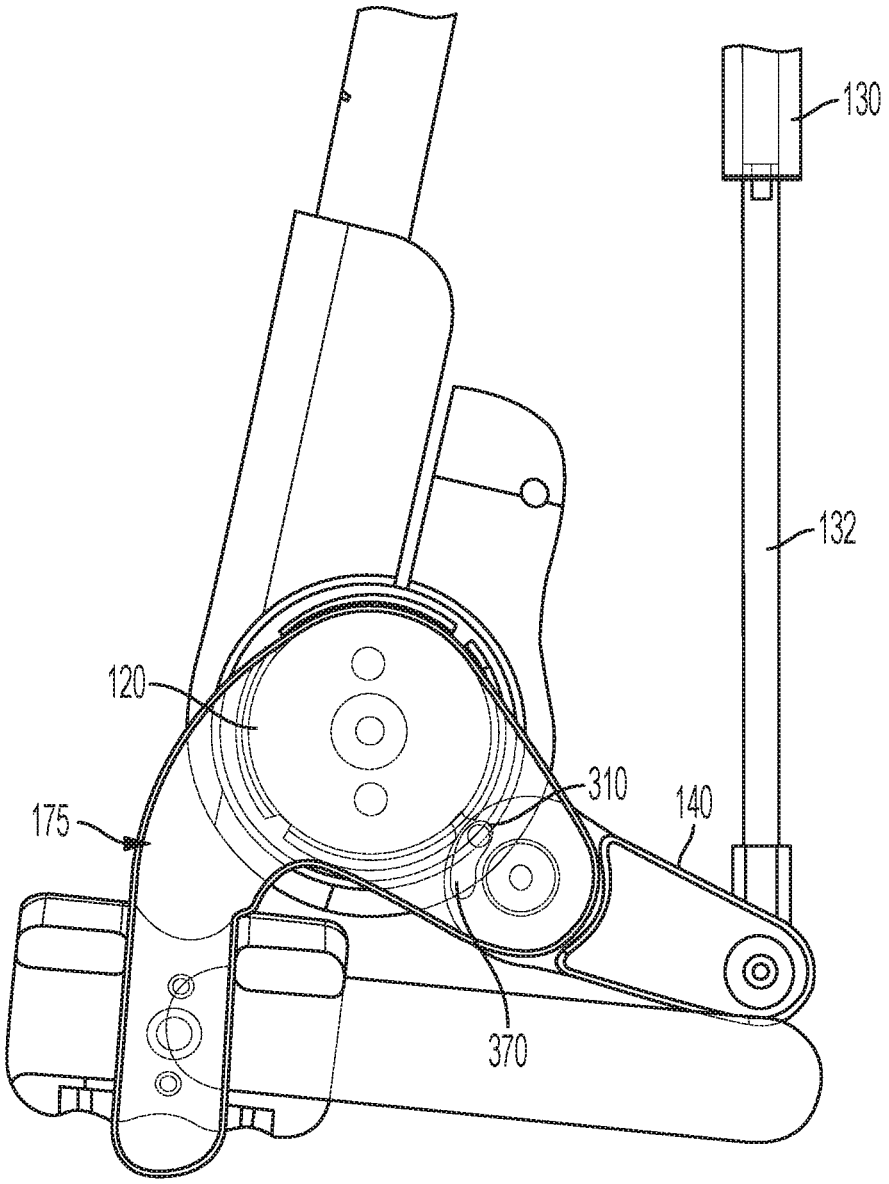
FIG. 5 schematically illustrates a lateral view of a limb support structure according to some embodiments disclosed herein.

FIG. 5 provides a lateral view of one embodiment of the leg support structure in a higher lithotomy position than shown in FIG. 4. The pivot bracket 140 comprises a rotated upwards since the gas piston strut 132 has reached its most extended position relative to gas piston 130. As the support structure moves higher through the lithotomy range of motion, the rotation of pivot bracket 140 can rotate upward to enable this higher lithotomy position. Range of motion control dowel 310 can be positioned against the right edge of range of motion control slot 370, thus limiting any further upward range of motion of pivot bracket 140 relative to proximal swivel joint 120 and mount plate 175.

Figure 6:
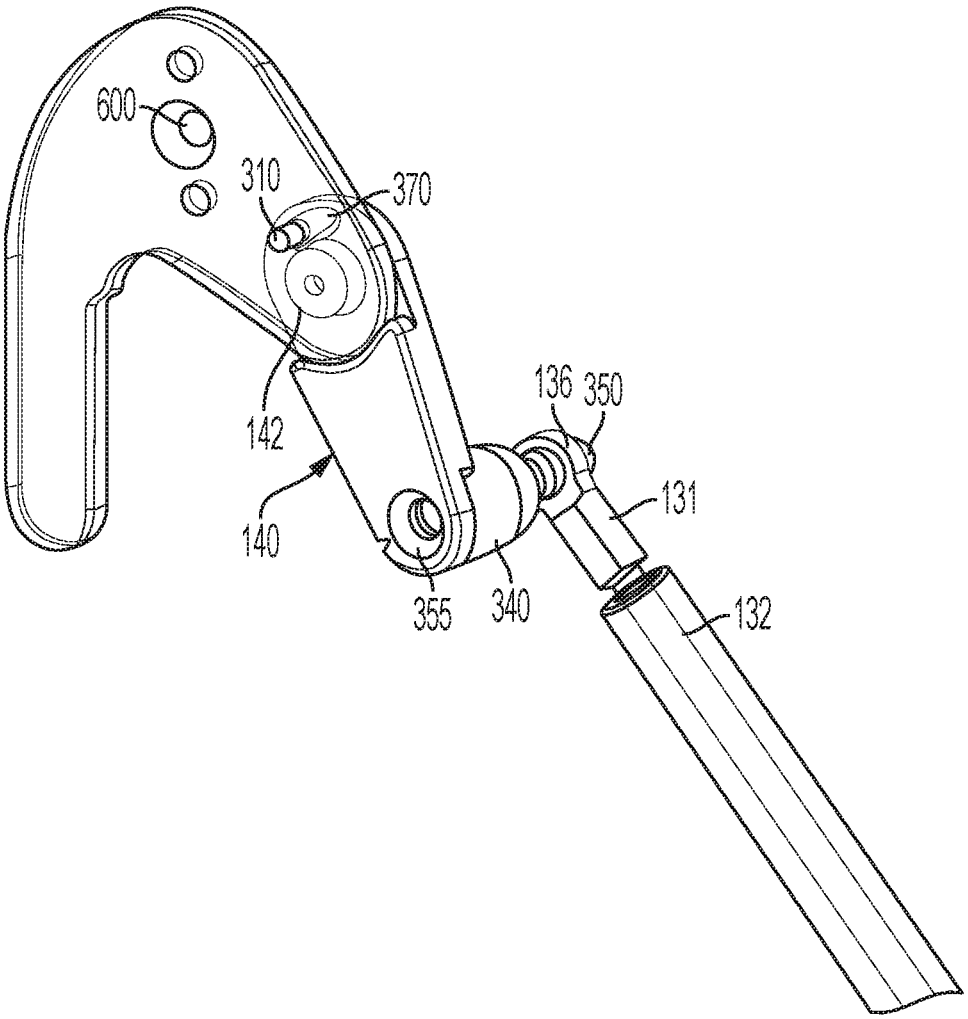
FIG. 6 schematically illustrates a view of a pivot bracket assembly according to some embodiments disclosed herein.

FIG. 6 provides an isometric view of one embodiment of the pivot bracket assembly (pivot bracket 140 with range of motion control slot 370, rotational hub 142 and range of motion control dowel 310) that is attached to mount plate 175. The hole 600 can allow attachment of the proximal swivel assembly (not shown) to mount plate 175. The Pivot bracket 140 can be attached to mount plate 175 by rotational hub 142, which can be inserted through mating hole 360 in mount plate 175. A range of motion control dowel 310 can be inserted into a range of motion control slot 370, which can be passed through hole 301 in mount plate 175 (FIG. 3).

A gas piston strut 132 can be attached to rod end bearing 131 that includes attachment point 136 (containing a spherical bearing) at its proximal end. A shoulder screw 350 passes through attachment point 136 into a threaded mating hole in the lateral end of mount post 340. The screw 320 passes through hole 355 in pivot bracket 140 and is threaded into threaded hole in the medial end of mount post 340, thus attaching pivot bracket 140 and mount post 340.

Figure 7:
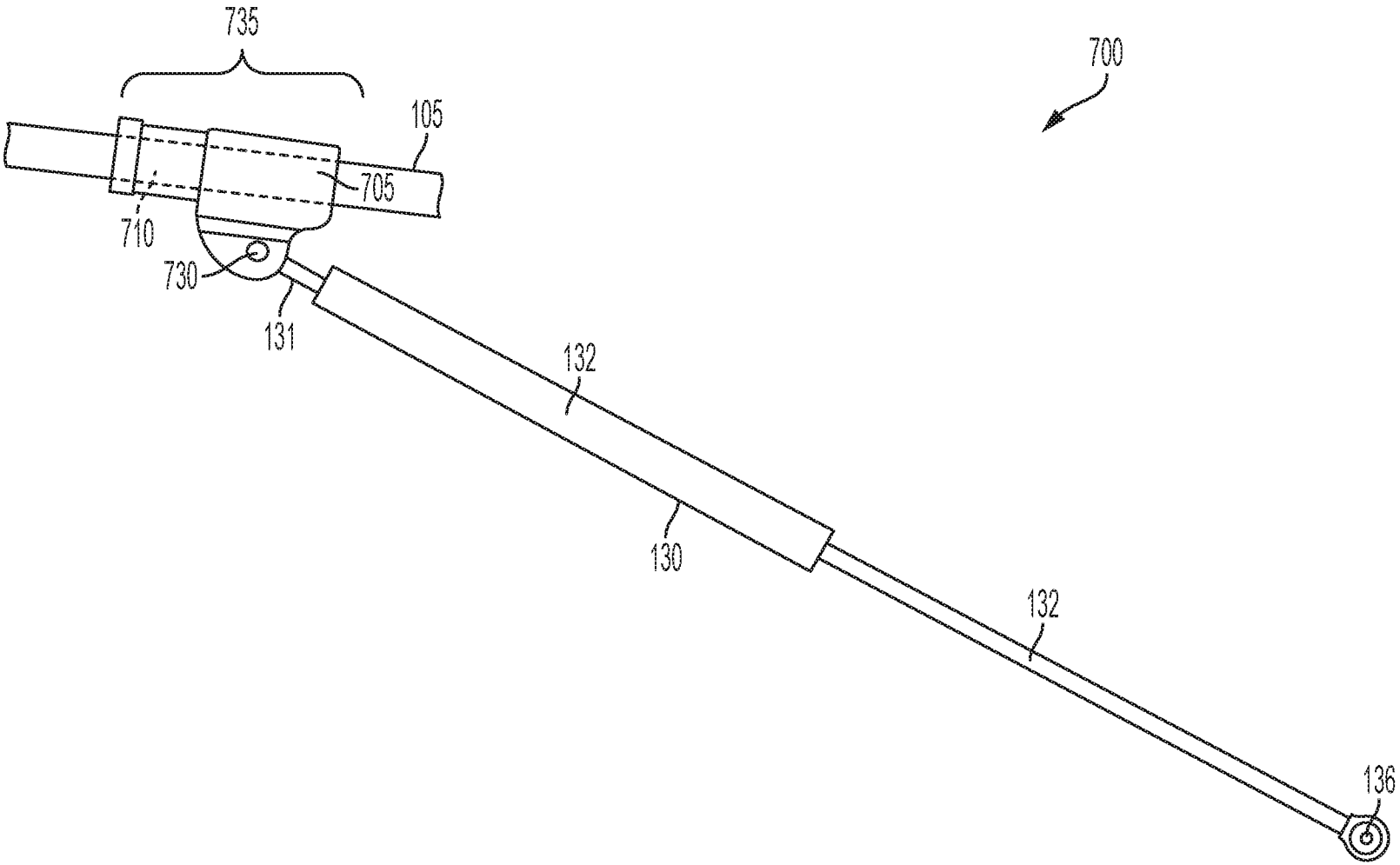
FIG. 7 schematically illustrates a gas piston system according to some embodiments disclosed herein.

FIG. 7 provides an example of gas piston system 700 according to some embodiments disclosed herein. The gas piston system 700 can include a mount assembly 735 with sleeve 705, which can slide along collar 710. The distal end of gas piston 130 can be coupled to the sleeve 705 by distal attachment component 131, and allowed to rotate freely about the axis of distal rod end bearing 131. A collar 710 can be fixed to the distal portion of the support structure 105 (FIG. 1) while the inside surface of sleeve 705 can be free to slide axially along the outside of the collar 710. The collar 710 can be configured such that it does not move relative to the support structure but is attached the support structure 105 by attachment components 810A, while the sleeve 705 is not directly attached to the support structure but slides axially along slotted guide 905 interface in collar 710, and is limited in its axially sliding range (and from rotation about the axis of the support structure 105) by attachment component 810B.

The sliding can occur when the support structure is raised into high lithotomy position and the gas piston assembly reaches its extended limit, thereby allowing the entire support structure to move beyond the point that the normal extended limit of the gas piston assembly, without sliding, would otherwise permit. The distal sliding mechanism can remain extended in the high lithotomy position (approximately 65 to 90 degrees) until the support structure is lowered. As it is lowered, the distal sliding mount assembly 735 can be compressed until it reaches a fully compressed state at which point the gas piston assembly becomes engaged and begins to compress below the 65 degree lithotomy point. Below this 65 degree position, the gas piston assembly (+65 degrees to −55 degrees) remains in compression. It should be understood that the gas piston can be substituted by at least one of a hydraulic system, a linear actuator, a mechanical spring, and/or similar support/reinforcement mechanisms.

Figure 8:
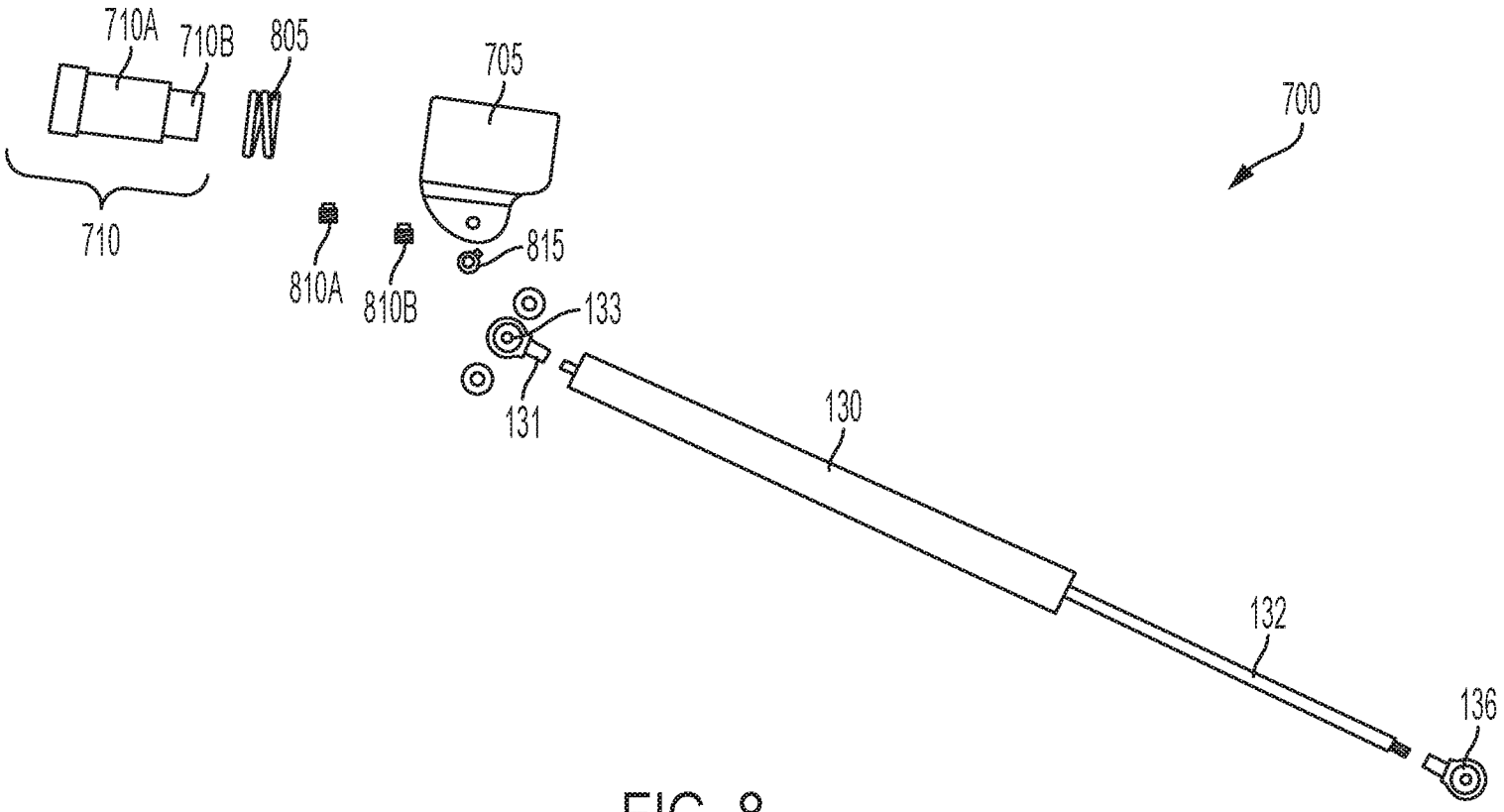
FIG. 8 schematically illustrates an exploded view of the gas piston system shown in FIG. 7.

FIG. 8 illustrates an exploded view of the gas piston system 700 shown in FIG. 7. As shown, the collar 710 can include an upper neck 710A and a lower neck 710B. The lower neck 710B can be smaller than the upper neck 710A in order to mate with a spring 805. The ridge at the interface between upper neck 710A and lower neck 710B can create a perpendicular surface to the axis of spring 805, thereby allowing a surface for the spring 805 to exert force. The other end of spring 805 can exert a force on the bottom of the counter-bored cavity in sleeve 705. The spring 805 can be fitted over lower neck 710B and can aid in the movement of gas piston system 700 between the fully extended position and a compressed position (i.e., when piston strut 132 is inserted into the gas piston 130). An attachment component 810A (e.g., a set screw) can be used to connect the collar 710 to the distal portion of support structure 105. An attachment component 810B can limit the axial range of motion of sleeve 705 along the upper neck of 710A of collar 710, such that it resists rotation about the axis of collar 710, and, consequently about the distal support axis 180.

Figure 9:
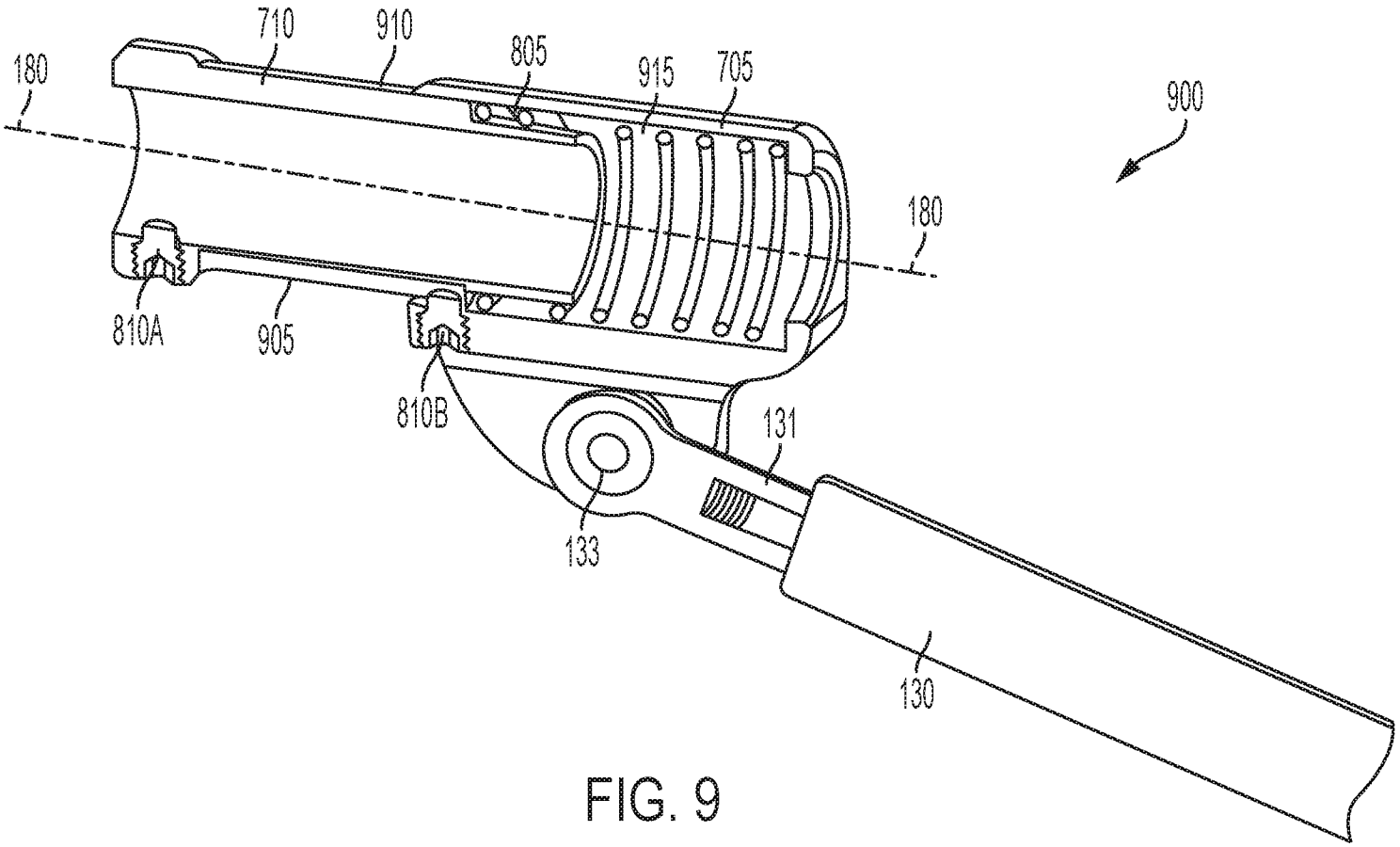
FIG. 9 schematically illustrates a cross-sectional view of an interface between a collar and a sleeve according to some embodiments disclosed herein.

FIG. 9 shows cross section view 900 of interface between collar 710 and sleeve 705. The outer surface 910 of upper neck 710A can slide inside inner surface 915 of sleeve 705. A set screw 810B can limit the range of motion and rotation of sleeve 705 about distal support axis 180 by the confinement in slotted guide 905 of collar 710. A distal rod end bearing 131 can enable attachment of gas piston 130 to sleeve 705 at attachment point 133. A threaded attachment component 131 comprises a spherical bearing at attachment point 133, allowing rotation about attachment point 133 during movement of the support system about the lithotomy axis 150 and lateral motion during movement of the support system in abduction and adduction. Attachment components 810A and 810B can be any suitable means know in the art, such as screws, pins, dowel, rods, other suitable attachments, etc. that can be used at each attachment point.

Although this specification discloses advantages in the context of certain illustrative, non-limiting embodiments, various changes, substitutions, permutations, and alterations may be made without departing from the scope of the specification as defined by the appended claims. Further, any feature described in connection with any one embodiment may also be applicable to any other embodiment.

What is claimed is:

1. A limb support assembly comprising:

at least one limb holder support structure configured for coupling to a platform for supporting a subject's limb, a locking swivel joint coupled to a proximal end of said limb holder support structure, the locking swivel joint being configured to maintain the limb holder support structure at a desired position relative to the platform; and a gas piston assembly comprising:

a distal gas piston mounting element coupled to said limb holder support structure at a point distal relative to the locking swivel joint; and a proximal gas piston mounting element connected to a limb holder support structure mounting element for coupling to the platform;

wherein at least one of the distal gas piston mounting element and the proximal gas piston mounting element is configured to be movable between at least two positions such that said distal gas piston mounting element moves relative to said at least one limb holder support structure and said proximal gas piston mounting element rotates relative to said limb holder support structure mounting element while the at least one limb holder support structure is moved through its range of motion.

2. The limb support assembly of claim 1, wherein the platform comprises at least one of a patient bed, a surgical table, and a patient exam room table.

3. The limb support assembly of claim 1, wherein the locking swivel joint is coupled to the platform via said limb holder support structure mounting element.

4. The limb support assembly of claim 1, wherein said distal gas piston mounting element is axially movable relative to said at least one limb holder support structure.

5. The limb support assembly of claim 1, wherein said proximal gas piston mounting element comprises a sleeve capable of sliding along a collar, wherein a proximal end of a gas piston of said gas piston assembly is coupled to the sleeve.

6. The limb support assembly of claim 5, wherein said collar is fixedly attached to a distal portion of said limb support structure.

7. The limb support assembly of claim 6, wherein said sleeve is axially movable along said collar.

8. The limb support assembly of claim 7, wherein said collar comprises at least one slotted guide along which the sleeve can slide.

9. The limb support assembly of claim 1, wherein both of said distal gas piston mounting element and said proximal gas piston mounting element are movable.

* * * * *